US009283586B2

(12) United States Patent
MacMillan

(10) Patent No.: US 9,283,586 B2
(45) Date of Patent: Mar. 15, 2016

(54) DRYWALL JOINT FINISHING TOOL

(71) Applicant: Donald Mark MacMillan, Maple Ridge, CA (US)

(72) Inventor: Donald Mark MacMillan, Maple Ridge, CA (US)

( * ) Notice: Subject to any disclaimer, the term of this patent is extended or adjusted under 35 U.S.C. 154(b) by 452 days.

(21) Appl. No.: 13/739,345

(22) Filed: Jan. 11, 2013

(65) Prior Publication Data

US 2013/0216294 A1 Aug. 22, 2013

Related U.S. Application Data

(60) Provisional application No. 61/585,411, filed on Jan. 11, 2012.

(51) Int. Cl.

| | |
|---|---|
| ***B05C 1/00*** | (2006.01) |
| ***E04F 21/02*** | (2006.01) |
| ***B05C 17/01*** | (2006.01) |
| ***A46B 11/00*** | (2006.01) |
| ***E04F 21/08*** | (2006.01) |
| ***E04F 21/165*** | (2006.01) |

(52) U.S. Cl.

CPC . *B05C 1/00* (2013.01); *A46B 11/00* (2013.01); *B05C 17/01* (2013.01); *E04F 21/02* (2013.01); *E04F 21/08* (2013.01); *E04F 21/165* (2013.01)

(58) Field of Classification Search

CPC ..... B05C 17/015; B05C 17/01; B05C 10/11; E04F 21/02

USPC ..... 425/87; 427/355; 401/139, 143

See application file for complete search history.

(56) References Cited

U.S. PATENT DOCUMENTS

| | | | | |
|---|---|---|---|---|
| 5,882,691 | A * | 3/1999 | Conboy | 425/87 |
| 6,146,039 | A * | 11/2000 | Pool et al. | 401/48 |
| 6,874,965 | B1 * | 4/2005 | Mondloch et al. | 401/5 |
| 2006/0257573 | A1 * | 11/2006 | Smythe | 427/355 |

* cited by examiner

*Primary Examiner* — David Walczak

*Assistant Examiner* — Thomas M Abebe

(74) *Attorney, Agent, or Firm* — Gardner Groff Greenwald & Villanueva, P.C.

(57) ABSTRACT

A tool for applying a cementitious mixture to a flat surface includes a head assembly for delivering the mixture to the flat surface. A housing is provided for containing a supply of the mixture and a control assembly is interposed between the housing and the head assembly for controlling the flow of the mixture from the housing to and through the head assembly. The control assembly is responsive to the housing being pressed against the flat surface to control the angle of the head assembly relative to the control assembly and to control the flow of the mixture through the head assembly.

18 Claims, 15 Drawing Sheets

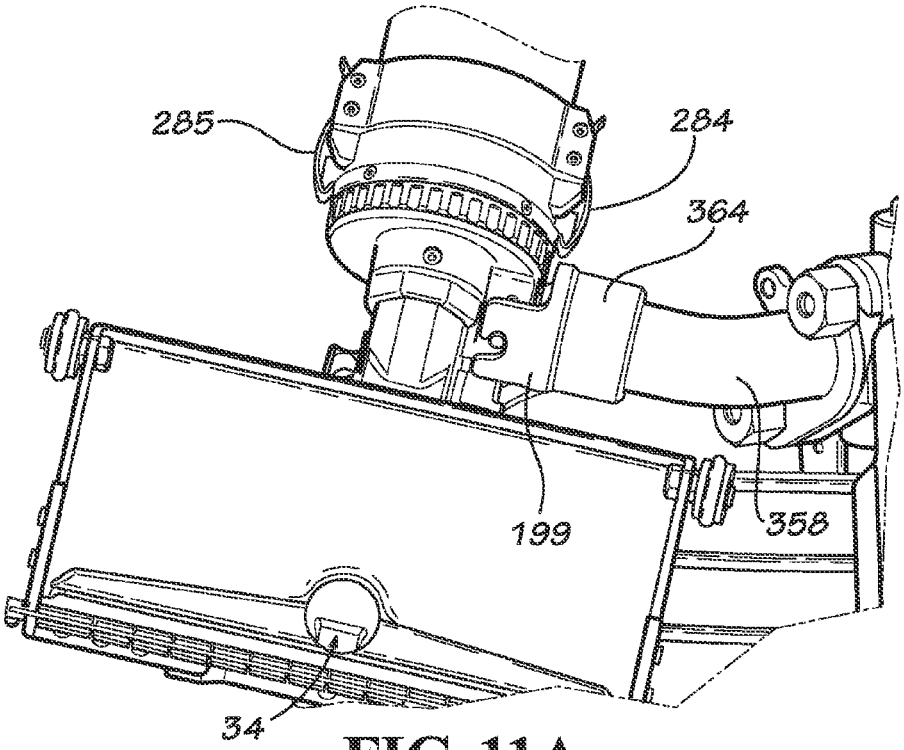
FIG. 11A
FIG. 11B
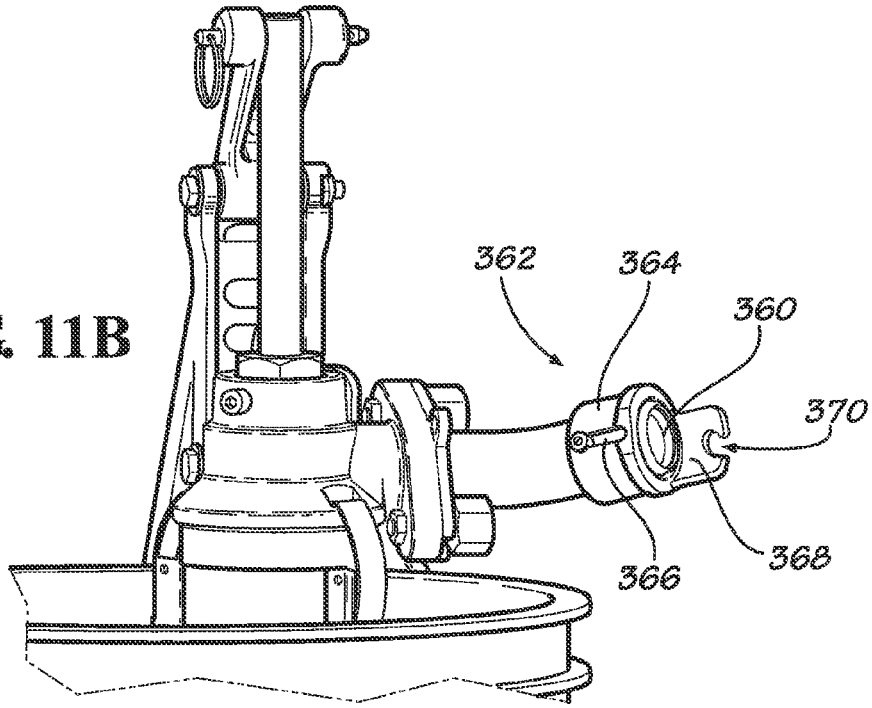

DRYWALL JOINT FINISHING TOOL

CROSS-REFERENCE TO RELATED APPLICATION

This application claims the priority benefit of U.S. provisional patent application No. 61/585,411 filed Jan. 11, 2012, which is hereby incorporated by reference.

SUMMARY OF THE INVENTION

Briefly described, in a preferred example form the present invention comprises a tool for applying a cementitious mixture to a flat surface and includes a head assembly for delivering the mixture to the flat surface. A housing is provided for containing a supply of the mixture and a control assembly is interposed between the housing and the head assembly for controlling the flow of the mixture from the housing to and through the head assembly. The control assembly is responsive to the housing being pressed against the flat surface to control the angle of the head assembly relative to the control assembly and to control the flow of the mixture through the head assembly.

Preferably, when the head assembly is pressed against the flat surface the head assembly can be pivoted relative to the control assembly and wherein when the head assembly is withdrawn from the flat surface the control assembly locks the head assembly in a fixed angular position relative to the control assembly.

Preferably, the control assembly includes a flow control valve and when the head assembly is pressed against the flat surface the flow control valve in the control assembly is opened to allow the mixture to flow therethrough and when the head assembly is withdrawn from the flat surface the flow control valve in the control assembly closes to stop the flow of the mixture therethrough.

Optionally, the control assembly includes a first external part and a second internal part movably mounted within the first external part and when the head assembly is pressed against the flat surface the second internal part is forced farther into the first external part and by such motion the head assembly is unlocked for pivotal motion relative to the control assembly and the flow of the mixture through the head assembly is permitted. Preferably, when the head assembly is pulled away from the flat surface the second internal part is partially withdrawn from the first external part and by such motion the head assembly is locked to prevent pivotal motion relative to the control assembly and the flow of the mixture through the head assembly is blocked.

An optional gas pressure cylinder can be provided for forcing the mixture from the housing through the control assembly and through the head assembly. Moreover, an optional visual scale can be provided for indicating the amount of mixture remaining in the housing. Preferably, a refill port is provided for pumping the mixture from an external reservoir into the housing.

Optionally, a second valve is provided, this second valve being a flow rate control valve which is operable to control and vary the rate of flow to and through the head assembly.

In one example form, the flow control valve comprises a variable orifice valve to meter the flow of mixture therethrough. Optionally, the flow control valve can include a first plate and a second plate overlying the first plate, with one of the plates being fixed and the other plate being pivotally mounted. The first plate includes a fill orifice and a flow control orifice and the second plate includes an elongated orifice adapted and configured such that the mixture control orifice can be varied in aperture as the pivotally mounted plate is pivoted, while the fill orifice remains unvaried in aperture regardless of the position of the pivotally mounted plate.

In another preferred form the invention comprises a tool for applying a cementitious mixture to a flat surface and includes a head assembly for delivering the mixture to the flat surface and a housing for containing a supply of the mixture. A control assembly is positioned between the housing and the head assembly for controlling the flow of the mixture from the housing to and through the head assembly, the control assembly being responsive to the housing being pressed against the flat surface to control the flow of the mixture through the head assembly.

In another example form, the invention comprises a tool for applying a cementitious mixture to a flat surface and includes a head assembly for delivering the mixture to the flat surface and a housing for containing a supply of the mixture. A control assembly is positioned between the housing and the head assembly for controlling the flow of the mixture from the housing to and through the head assembly, the control assembly being responsive to the housing being pressed against the flat surface to control the angle of the head assembly relative to the control assembly.

BRIEF DESCRIPTION OF THE DRAWINGS

FIG. 11A is a rear perspective view of the wall finishing apparatus mounted to the filling station shown in FIG. 1.

FIG. 11B is a perspective view of the filling station shown in FIG. 1, and showing details of a bayonet mount for mounting to the wall finishing apparatus.

DESCRIPTION OF SAMPLE EMBODIMENTS

Figure 1:
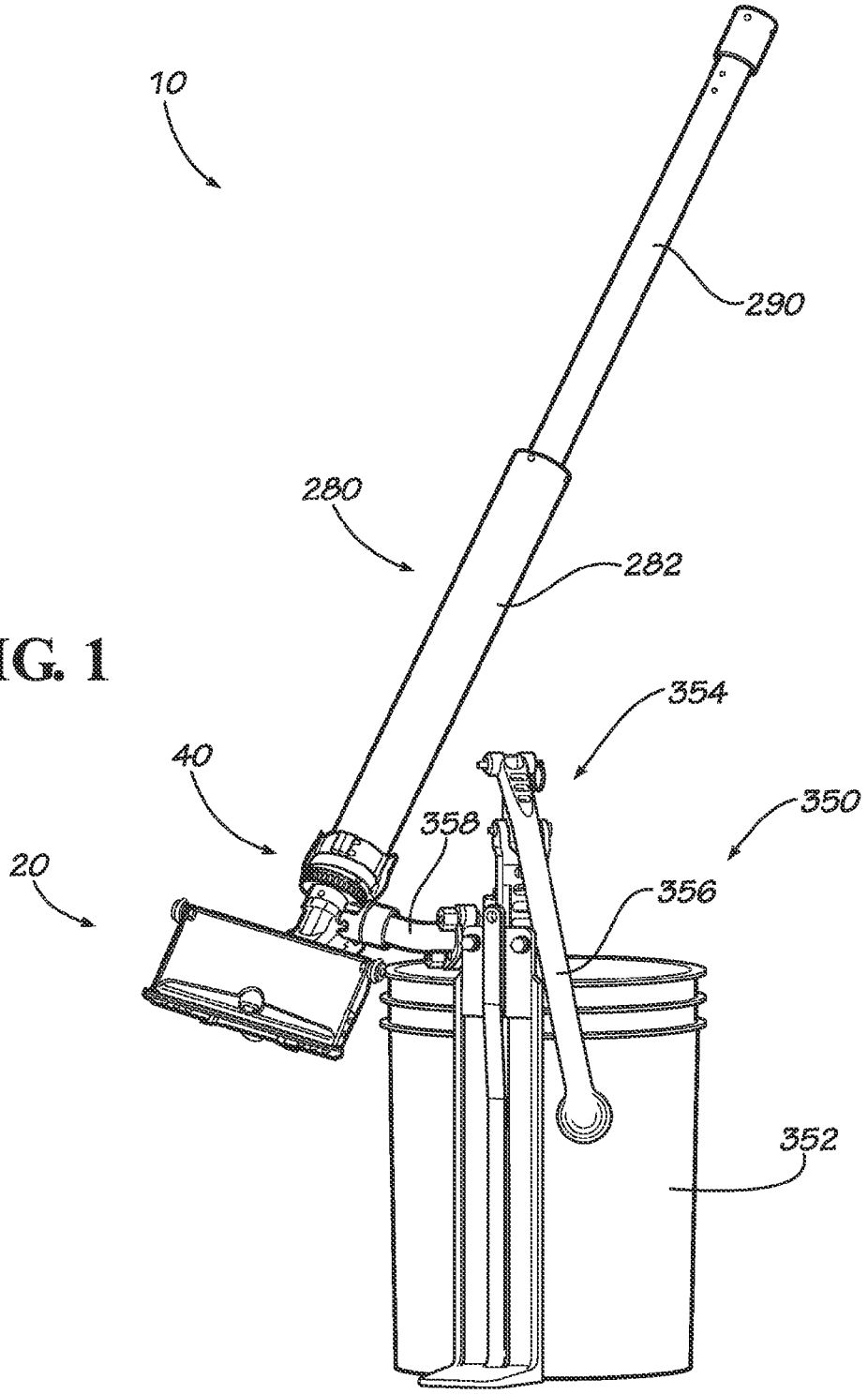
FIG. 1 is rear perspective view of a wall finishing apparatus according to an example embodiment of the present invention, and mounted to an optional filling station.

It is to be understood that this invention is not limited to the specific devices, methods, conditions, or parameters described and/or shown herein, and that the terminology used herein is for the purpose of describing particular embodiments by way of example only. Thus, the terminology is intended to be broadly construed and is not intended to be limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

With reference now to the drawing figures, wherein like reference numbers represent corresponding parts throughout the several views, FIGS. 1-14 show a drywall joint tool or wall finishing apparatus 10 for applying a cementitious mixture to a flat surface according to a first example embodiment of the present invention. In general, the tool 10 comprises a head assembly 20, a control assembly 40 and a cylindrical reservoir 280. In example embodiments, the head assembly 20 delivers the cementitious mixture to the flat surface and is pivotally mounted to the control assembly 40. The control assembly 40 controls the flow of the mixture to the head assembly 20 from the mounted cylindrical reservoir 280, wherein the cylindrical reservoir 280 contains the supply of cementitious mixture, such as joint compound (generally referred to as "mud" in the trade).

Figure 2:
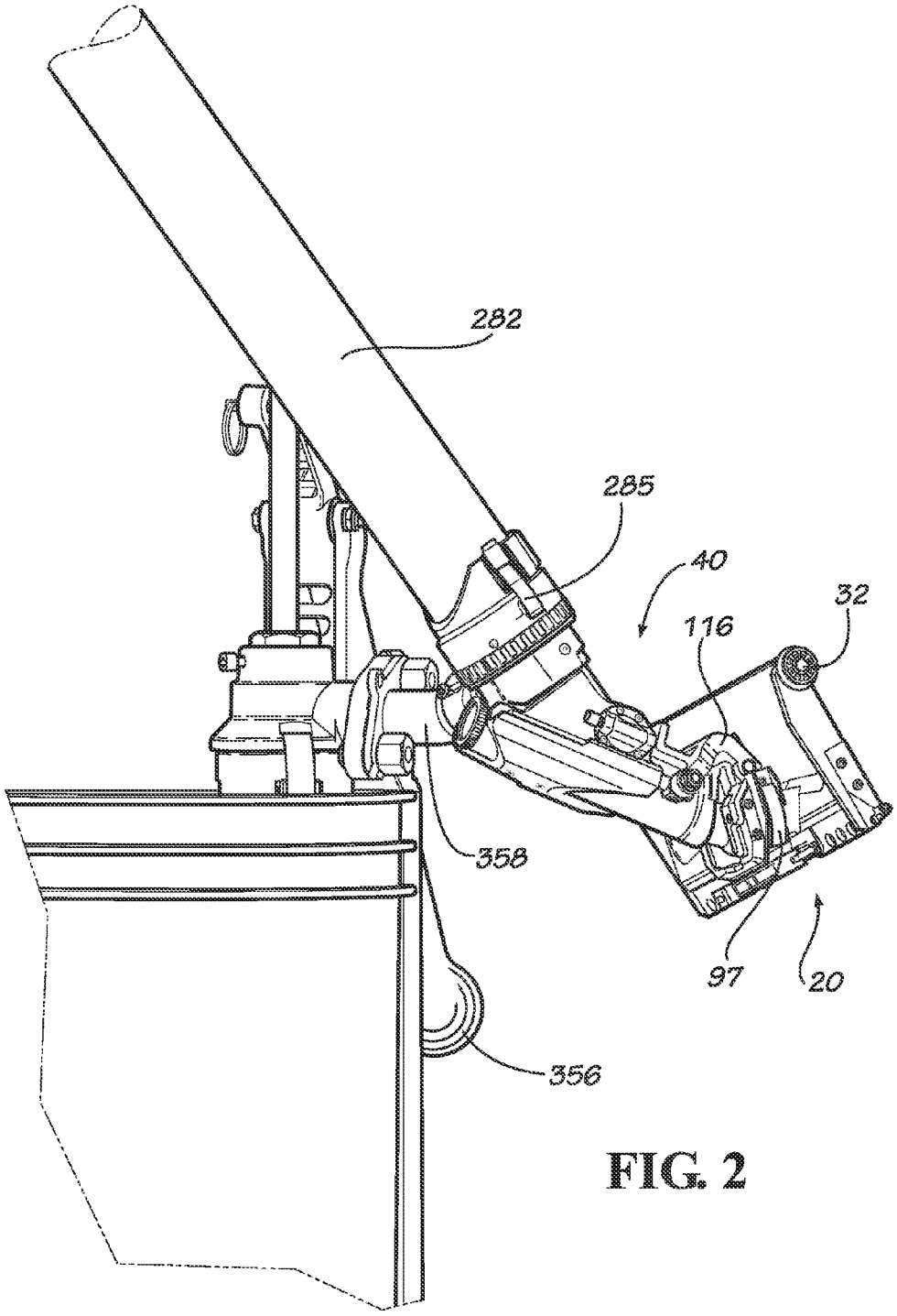
FIG. 2 is a front perspective view of the wall finishing apparatus mounted to the optional filling station shown in FIG. 1.

FIGS. 1-2 show the wall finishing apparatus 10 mounted to an optional filling station 350 for filling the cylindrical reservoir 280 with a supply of cementitious mixture. The filling station 350 comprises a manual pump 354 mounted to a tank 352 containing the cementitious mixture, wherein the manual pump 354 moves the mixture from the reservoir and supplies the mixture to the cylindrical reservoir 280 of the wall finishing apparatus 10. An inlet orifice of the manual pump 354 extends within the tank and is in fluid communication with the mixture. An outlet orifice of the manual pump 354 is proximal the top side of the tank and further comprises a filler neck 358 mounted thereto. A pump handle 356 is pivotally mounted proximal the outlet orifice and is manually pivoted up and down to pump the mixture from the tank. The up and down motion of the pivotally-mounted pump handle 356 draws the mixture through the inlet port and discharges the mixture through the outlet orifice. The filler neck 358 of the manual pump is mounted to a filler port 198 of the control assembly 40 (see FIG. 3) and allows the discharged mixture flowing from the outlet orifice to flow into and within the control assembly 40. Further, the mixture flowing into and within the control assembly continues to flow and is stored within a mud supply tube 282 of the cylindrical reservoir 280.

Figure 8:
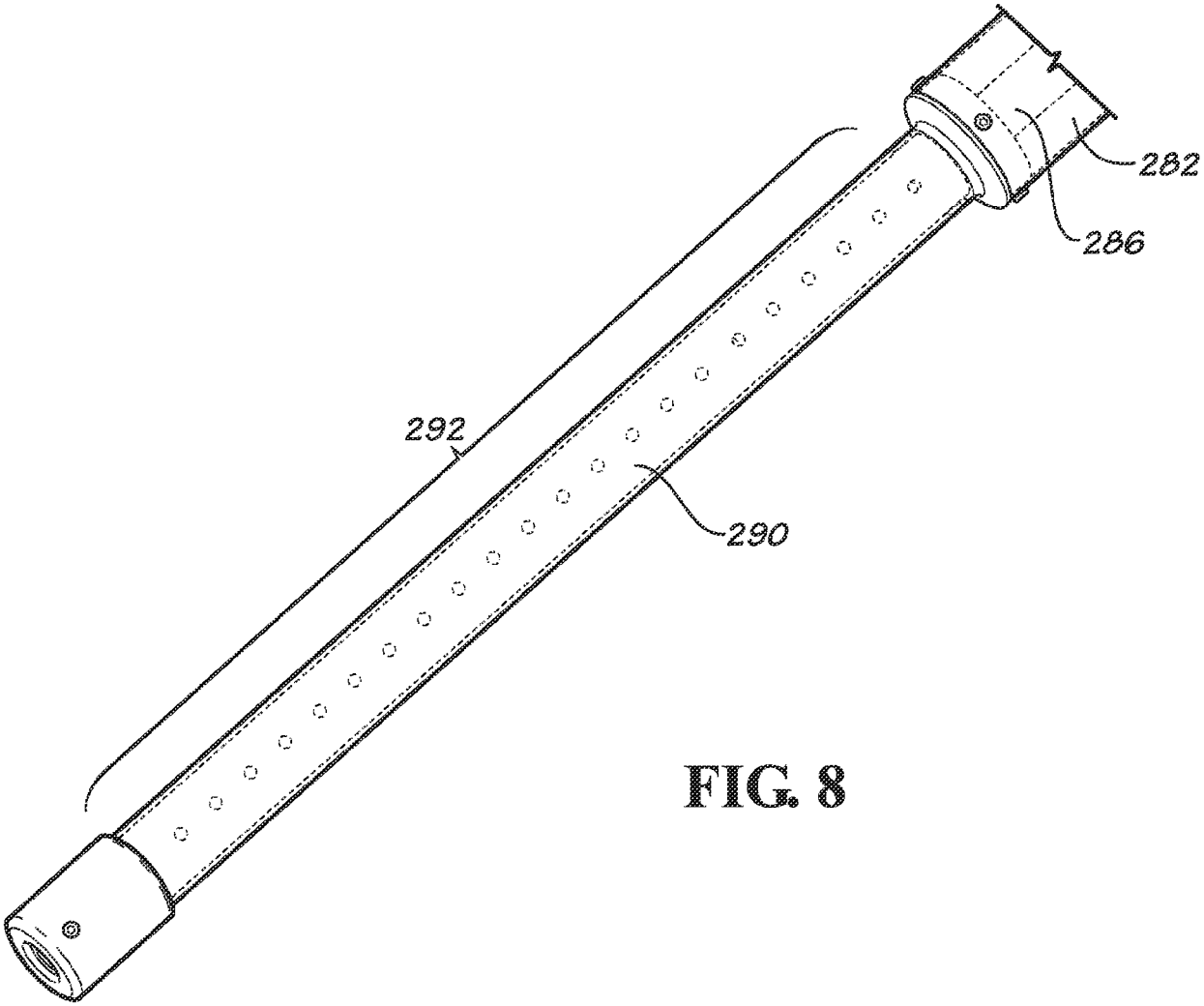
FIG. 8 is a perspective view of a gas pressure cylinder of the wall finishing apparatus of FIG. 1.
Figure 10:
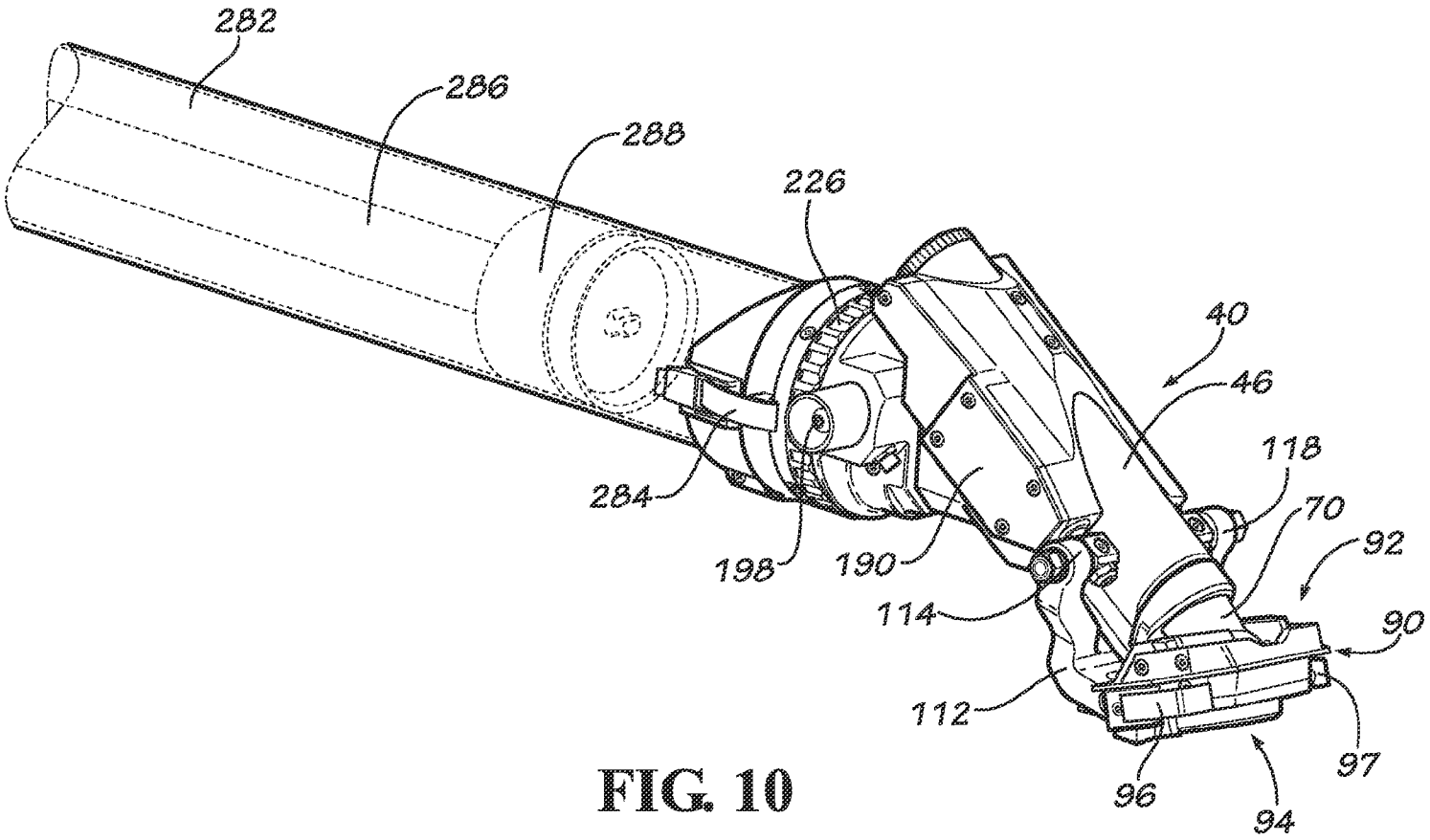
FIG. 10 is a perspective view of the wall finishing apparatus shown in FIG. 1, showing the control assembly assembled with a mud supply tube.

As the mixture flows within the mud supply tube 282, a plunger 288 mounted within a smaller cylinder 290 (having a contour substantially similar to the internal contour of the mud supply tube) is forced to the rear side of the mud supply tube, wherein the plunger translates along the longitudinal axis of the mud supply tube and charges a gas pressure cylinder 286 (see FIG. 10). The gas pressure cylinder 286 is mounted to the rear side of the mud supply tube and comprises a volume of gas stored therein. In an uncompressed state, the gas pressure cylinder is fully expanded and forces the plunger forward toward the control assembly 40. In a compressed state, the mixture within the mud supply tube forces the plunger and mounted gas pressure cylinder toward the rear side of the mud supply tube, causing the gas pressure cylinder to compress and bias the plunger forward toward the control assembly 40. Moreover, the filling station 350 simultaneously supplies the mixture to the mud supply tube 282 and charges the gas pressure cylinder 286 of the cylindrical reservoir 280. Additionally, an optional visual scale can be provided on the gas pressure cylinder 286 for indicating the amount of mixture remaining in the mud supply tube of the cylindrical reservoir 280. As depicted in FIG. 8, the gas pressure cylinder comprises cylindrical cover 290 having a visual scale 292 for indicating the amount of cementitious mixture within the mud supply tube 282. As the cementitious mixture is discharged from the mud supply tube 282, the plunger 288 and gas pressure cylinder 284 further extend within the mud supply tube, and the portion of the pressure cylinder still within the cylindrical cover directly corresponds to the amount of cementitious mixture within the mud supply tube 282.

Figure 3:
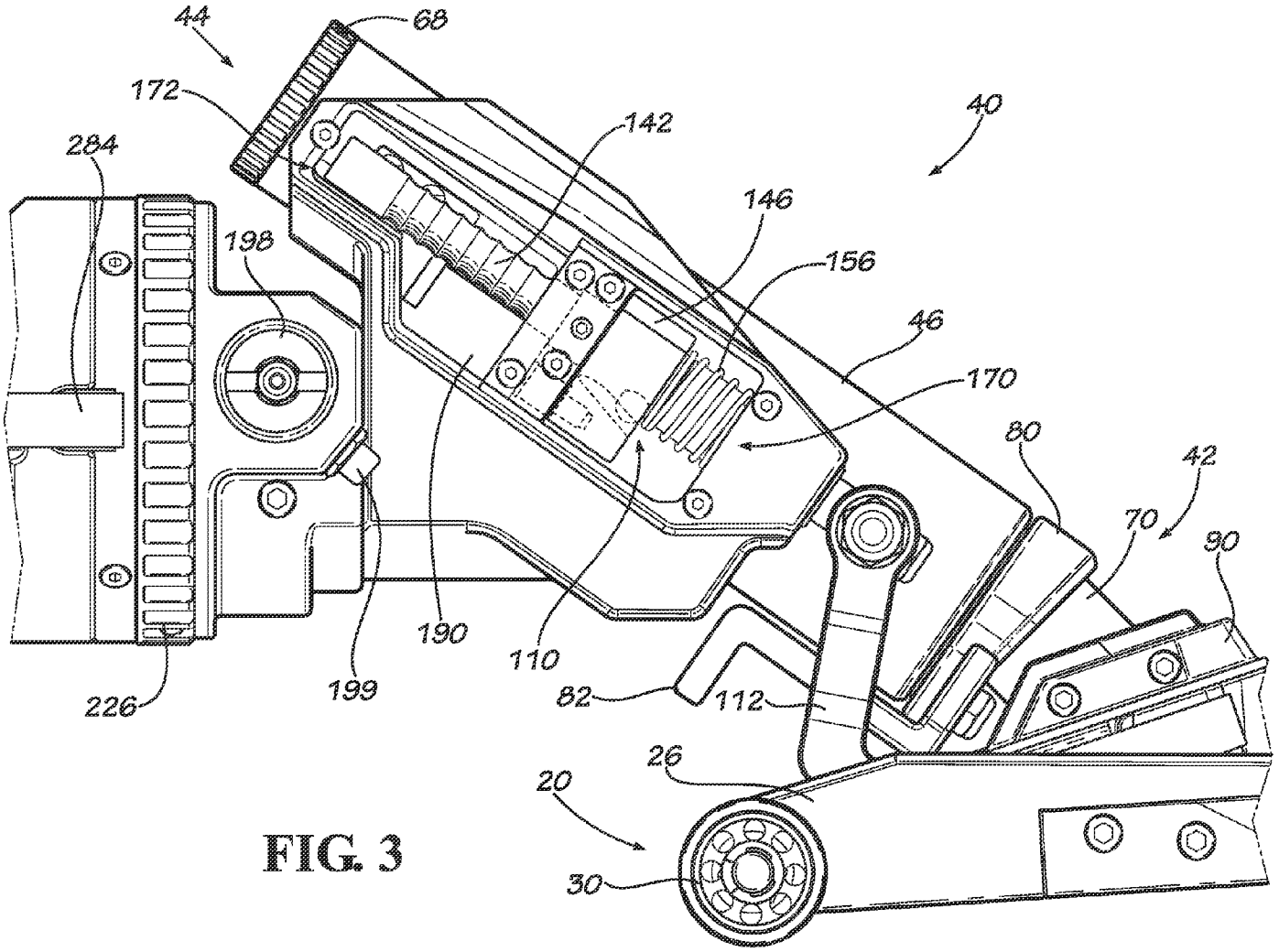
FIG. 3 is a schematic side view of a control assembly and a head assembly of the wall finishing apparatus shown in FIG. 1.

FIG. 3 is a schematic side view of the control assembly 40 and the head assembly 20. In example embodiments, the control assembly 40 is responsive to the head assembly 20 being pressed against a flat surface to control the angle of the head assembly 20 relative to the control assembly and to control the flow of the mixture through the head assembly 20. In general, the control assembly 40 comprises an outer cylinder 46, an inner cylinder 60, a biasing spring 66 and a ball-extension cylinder 70 (see FIG. 4). The outer cylinder 46 comprises an open end 47 proximal the front side 42 of the control assembly and a closed end 48 proximal the rear side 44 of the control assembly 40. The inner cylinder 60, having an open end 61 proximal the front side 42 of the control assembly 40 and a closed end 62 proximal the rear side 44 of the control assembly, is aligned axially with the outer cylinder 46 and translates within the open side 47 of the outer cylinder 46 along the longitudinal axis of the outer cylinder 46. Preferably, the inner surface of the outer cylinder 46 and the outer surface of the inner cylinder 60 have substantially similar contours and perimeters. The biasing spring 66 is aligned axially with the outer cylinder 46 and mounts within the outer cylinder 46 proximal the closed end 48. The biasing spring 66 further abuts the closed end 62 of the axially-aligned inner cylinder 60 and urges the inner cylinder 60 to extend toward the front side 42 of the control assembly 40. Optionally, the closed ends 48, 62 can comprise a removable cap 68 to facilitate cleaning.

Figure 4:
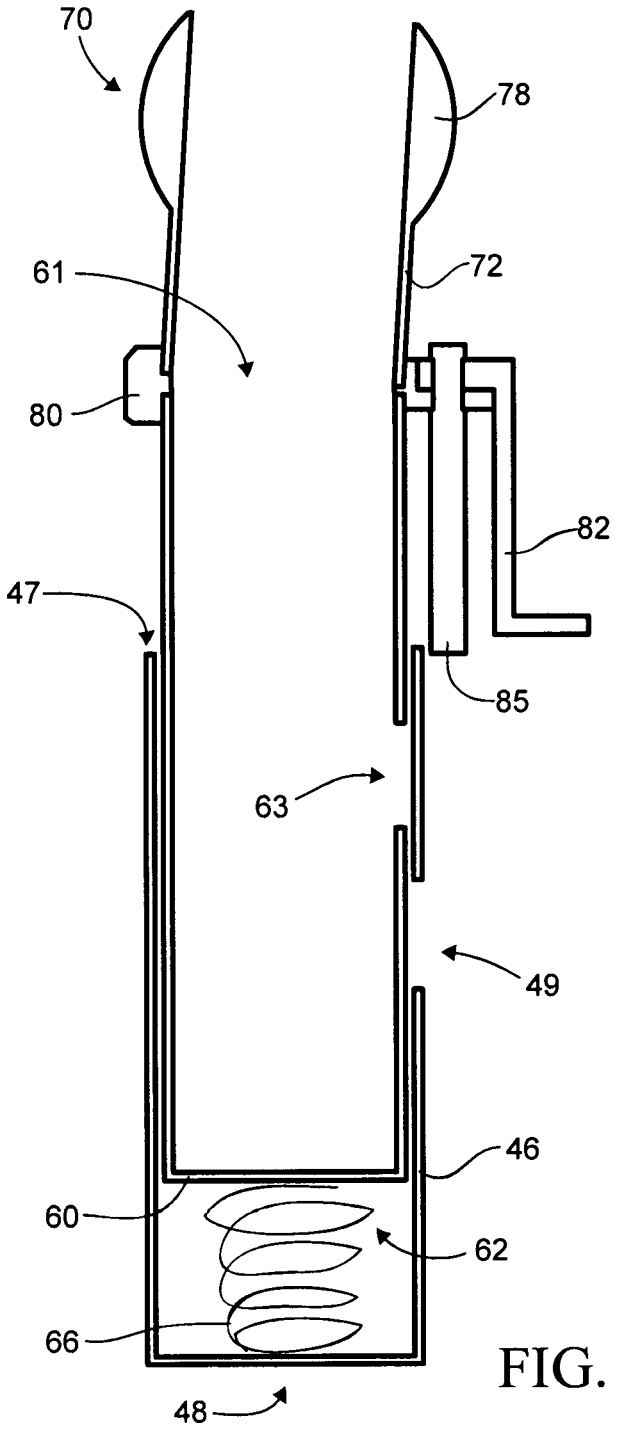
FIG. 4 is a schematic side view of portions of the control assembly of FIG. 3.

The ball-extension cylinder 70 generally comprises a cylindrical portion 72 and an integrally connected ball portion 78, each having a hole therethrough. An end of the cylindrical portion 72, comprising a contour and perimeter substantially similar to the inner cylinder 60, mounts to the open end 61 of the inner cylinder 60 by a collar 80. The collar 80 preferably seals the abutment between the ball-extension cylinder 70 and the inner cylinder 60. As depicted in FIG. 4, a first portion of the collar 80 surrounds the open end 61 of inner cylinder 60 that is axially aligned therein. A second portion of the collar surrounds the cylindrical portion 72 of the ball-extension cylinder 70, wherein the cylindrical portion 72 axis is angularly offset from the axes of the collar 80 and inner cylinder 60. Preferably, the second portion of the collar 80 comprises an angled inner surface to accommodate the angled offset of the ball-extension cylinder 70. In additional example embodiments, the inner cylinder, collar, and ball-extension cylinder can be axially aligned with one another.

In preferred embodiments, the inner cylinder 60 translates within the open side 47 of the outer cylinder 46 along the longitudinal axis of the same. Preferably, the collar 80 restricts the distance the inner cylinder 60 can translate within the outer cylinder 46. Additionally, a cylindrical guide pin 85 is mounted to the collar and extends toward the closed end 48 of the outer cylinder 46. As the inner cylinder 60 translates within the outer cylinder, the guide pin 85 translates within a housing (not shown) of the outer cylinder that is proximal the exterior open end 47 to help guide the translational movement of the inner cylinder 60. Preferably, the guide pin 85 is restricted to translation within the housing of the outer cylinder, thereby preventing the inner cylinder 60 from rotating about its longitudinal axis within the outer cylinder 46.

In additional example embodiments a manual control handle or primer lever 82 can be mounted to the collar 80 for permitting cementitious mixture to flow within the head assembly 20 of the wall finishing apparatus 10. The manual control handle 82 mounts to the collar 80 below the outer cylinder 46 and partially extends toward the rear side 44 of the control assembly. As depicted, the guide pin 85 secures the manual control handle 82 to the collar 80. Preferably, after the mud supply tube 282 is filled with the cementitious mixture, the manual control 82 handle is used to prime and/or fill the control assembly 40 and the head assembly 20 with the cementitious mixture. This feature allows the user to press the head assembly 20 against a flat surface after the mixture has begun flowing. This manual control handle or primer lever also is useful for emptying the tool of any unused drywall mud.

Figure 9:
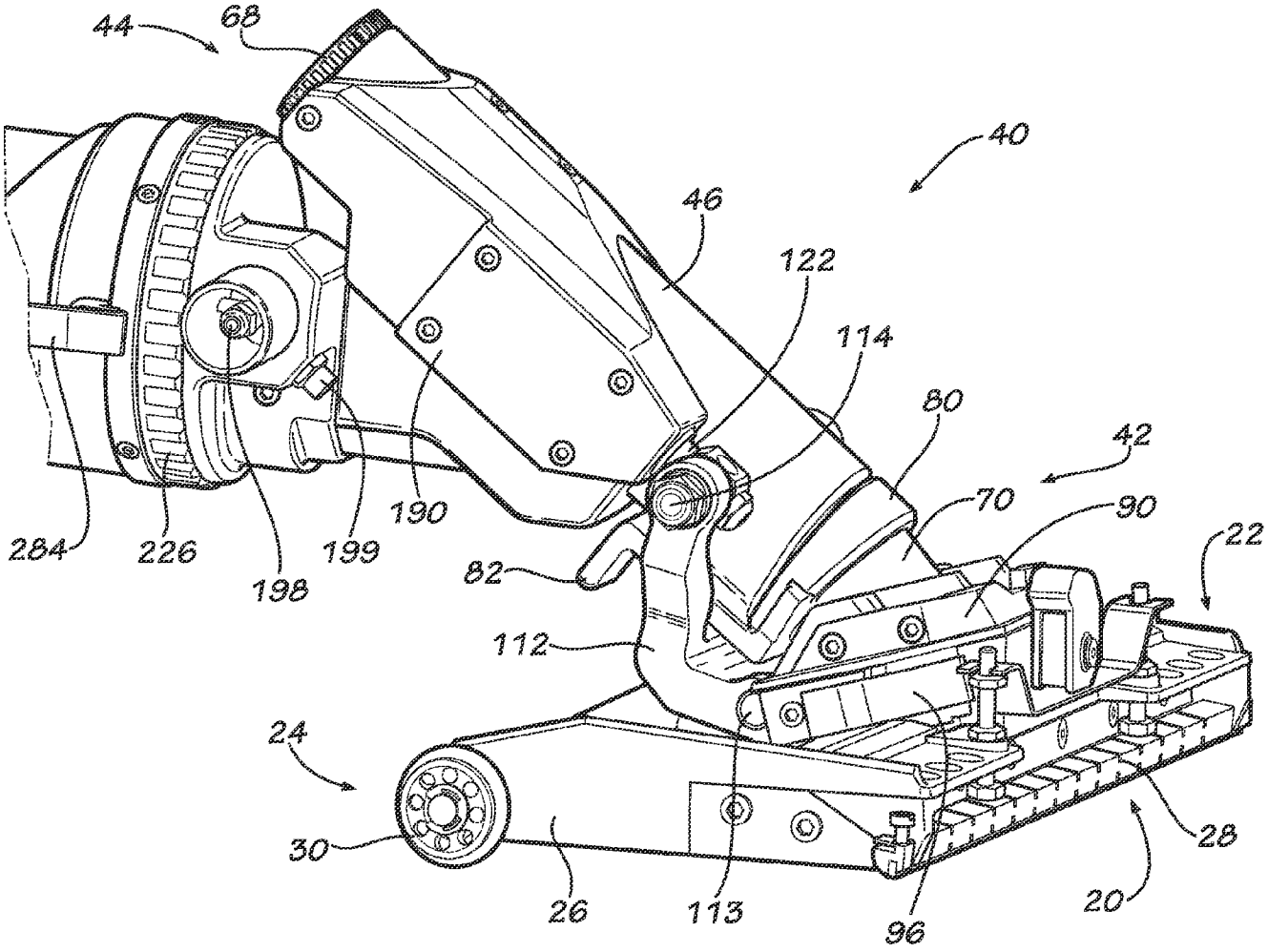
FIG. 9 is a perspective view of the control assembly and head assembly of the wall finishing apparatus shown in FIG. 1.

Now referring to FIGS. 4, 9 and 10, the ball portion 78 of the ball-extension cylinder 70 generally comprises a spherical or "ball-like" geometry for further mounting to the head assembly 20, wherein a ball joint collar 90 is interposed between the ball portion 78 and a flat finishing box 26 of the head assembly 20. A top side 92 of the ball joint collar 90 comprises a bore/recess having a spherical geometry substantially similar to the ball portion 78, thereby providing a ball joint connection when the ball portion 78 is mounted within the bore (see in particular FIGS. 9-10). The ball joint connection thereby permits the ball joint collar 90 to rotate and to pivot. A bottom side 94 of the ball joint collar 90 comprises a generally flat surface for mounting to the flat finishing box 26. Securing clips 96, 97 proximal the bottom side 94 further secure the ball joint collar 90 to the finishing box 26. Additionally, the ball joint collar 90 provides a seal between the ball portion 78 and the flat finishing box 26 for preventing mixture leakage when transferring the mixture from the mud supply tube 282 to the flat finishing box 26.

Referring still to FIG. 4, the assembled cylinders 46, 60, ball-extension cylinder 70 and biasing spring 66 further act as a mixture flow control valve for controlling the flow of mixture from the mud supply tube 282 of the cylindrical reservoir 280 to the head assembly 20. The outer cylinder 46 comprises a circular orifice 49 positioned along a side of the outer cylinder 46 near its midpoint, and the inner cylinder 60 comprises a circular orifice 63 positioned along the same side as the outer cylinder circular orifice 49 within the front half of the inner cylinder 60. Preferably, the position of the inner cylinder circular orifice 63 is such that the orifices 49, 63 align when the biasing spring is compressed by retracting the ball-extension cylinder 70 and inner cylinder 60 toward the rear side 44 of the control assembly 40, further abutting the collar 80 against the open end 47 of the outer cylinder. Moreover, the orifices 49, 63 are misaligned and provide no opening therethrough when the biasing spring 66 urges the inner cylinder 60 and the ball-extension cylinder 70 toward the front side 42 of the control assembly 40.

Figure 14A:
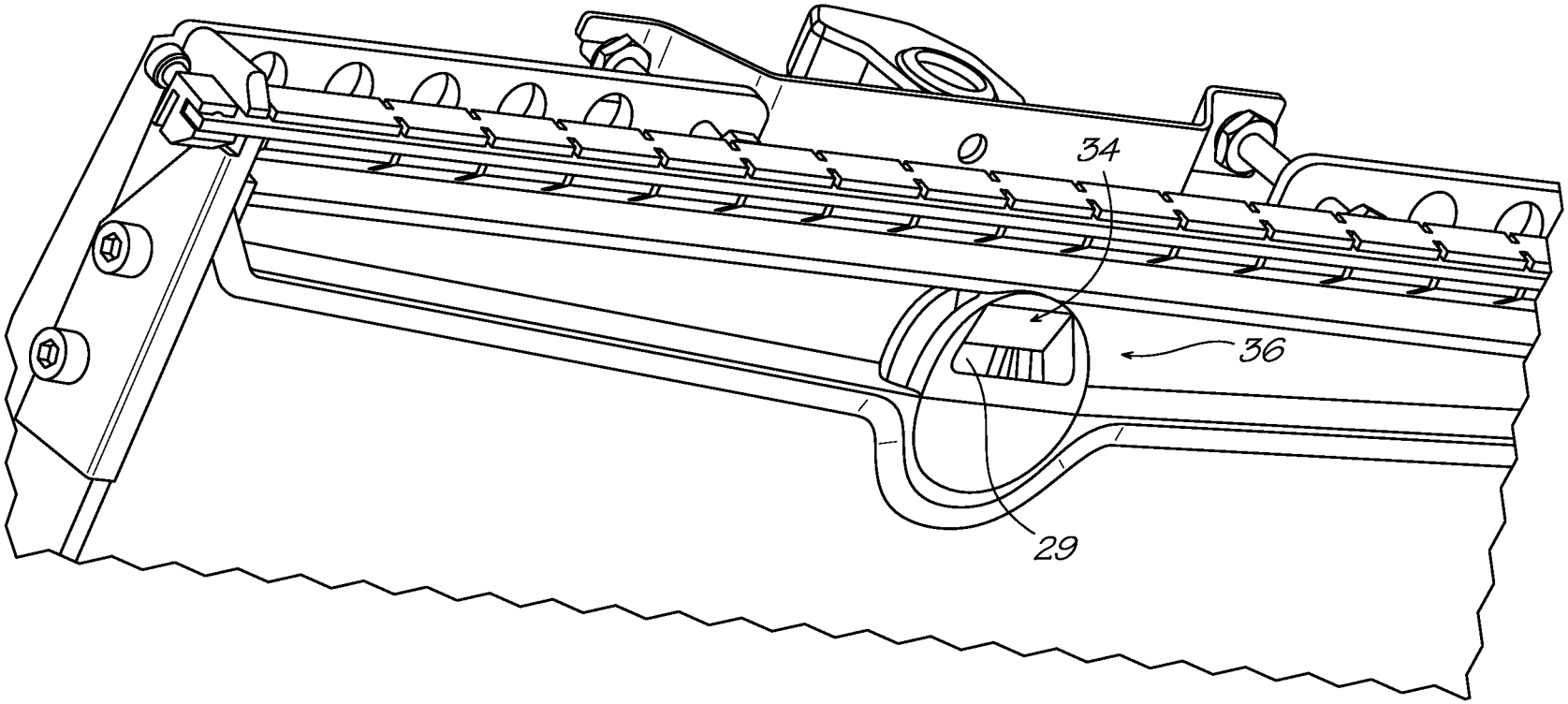
FIG. 14A is a bottom perspective view of a flat finishing box of the head assembly of the wall finishing apparatus of FIG. 1.
Figure 14B:
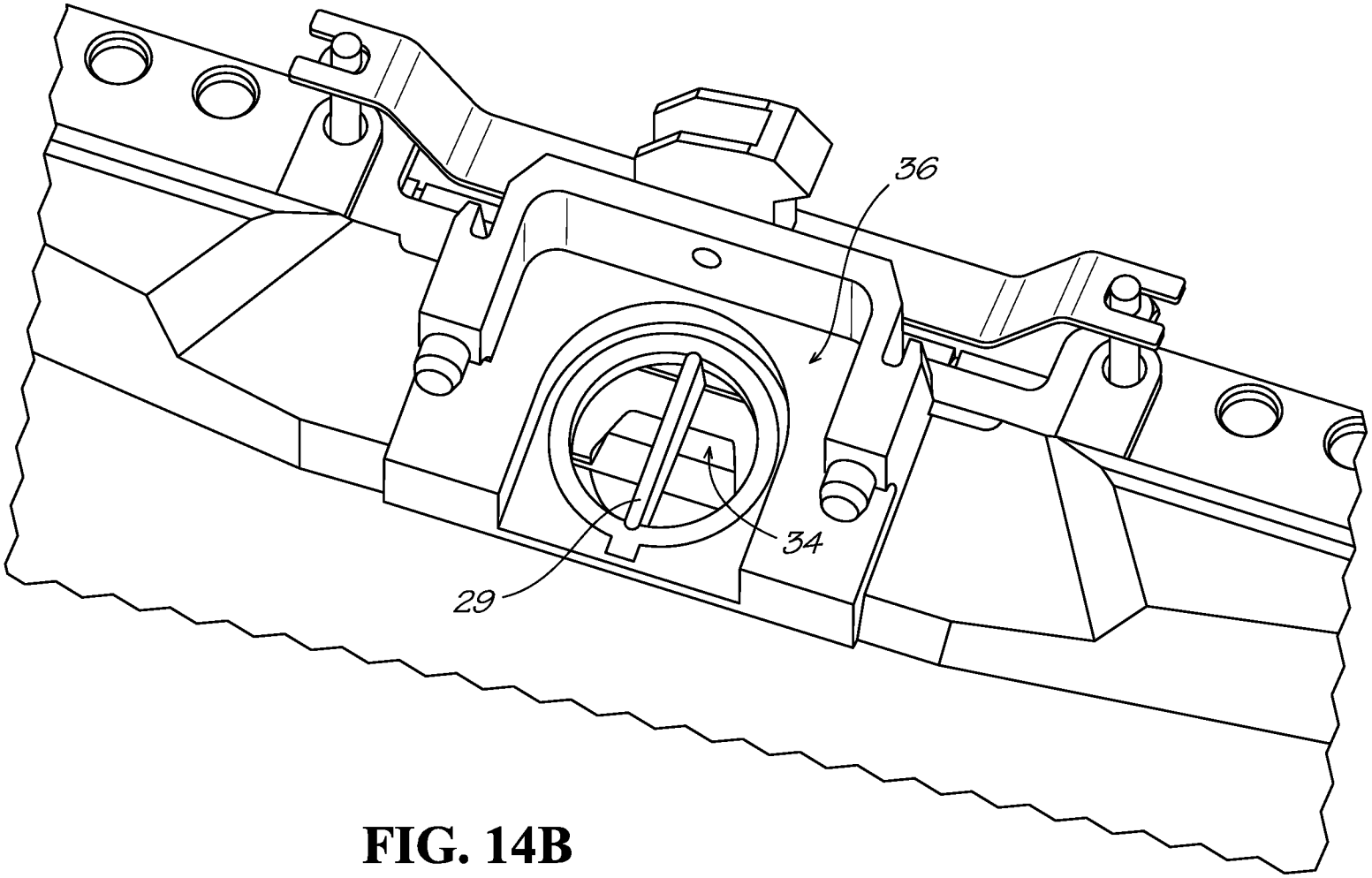
FIG. 14B shows a detailed view of the flat finishing box shown in FIG. 14A, showing a mouth opening comprising a mud diffuser having one or more ribs.

Referring now to FIGS. 9, 14A, 14B, the head assembly 20 of the wall finishing apparatus 10 generally comprises the flat finishing box 26 for delivering the mixture to the flat surface. The box 26 can be fitted with a plurality of different heads, each head 28 configured to provide one of the three standard width swaths of the cementitious mixture. For example a head width of 8", 10" and 12" can be provided. A mouth opening 34 is formed at the bottom side of the box 26 proximal the lengthwise midpoint of the mounted head 28 and provides an orifice for the cementitious mixture to flow through. As the box 26 is applied to a flat surface and the mixture is permitted to flow, the mixture is contained by the width of the head 28 to provide a swath of the same width (see FIG. 14A, 14B). Optionally, the mouth opening 34 can comprise a mud diffuser 36 that evenly distributes the mud across the entire width of the head 28 for complete coverage. Preferably, the one or more ribs 29 lying within the mouth opening 34 function as a mud diffuser to distribute the mixture. Optionally, such a mud diffuser can permit the mud to be moved in multiple directions for complete coverage. This also tends to control undesirable ejection of material when priming the tool.

As depicted in FIG. 9, a top side 22 of the box 26 comprises one or more mounting pins for accommodating the ball joint collar securing clips 96, 97 when the head assembly 20 is mounted to the ball joint collar 90. An orifice proximal the mounting pins of the top side 22 of the box 26 receives the mixture from the ball-extension cylinder 70 that is pivotally mounted within the bore of the ball joint collar 90 and provides a channel to deliver the mixture to the head 28. When applying the cementitious mixture to a flat surface, optional wheels 30, 32 mounted to the sides near the back 24 of the box 26, can rotate for providing a smooth and continuous swath of mixture. In additional example embodiments, the head 28 can be replaced with a nail spotter head or finishing head (not shown) for filling nail and/or screw depressions with the cementitious mixture. The nail spotter head mounts to the box in the same manner as the head 28 and typically comprises a swath width of 3" or 4". Optionally, the nail spotter head can include a mud diffuser as described above.

Referring again to FIGS. 3, 5, 12, in additional example embodiments, an angle locking system 110 of the control assembly 40 selectively permits the adjustment of the angle of the head assembly 20 relative to the control assembly 40 when the box 26 is pressed against a flat surface. In general, the angle locking system 110 is mounted within the manifold 190 and comprises grooved shafts 142, 144, a lock collar 146, a lock ball 154, a biasing spring 156, a secondary collar 160, a fastener 164 and an L-shaped arm 166. An L-shaped strut or yoke 112 having first ends 113, 117 pivotally mounted to a left side and a right side of the ball joint collar 90, extend to second ends 114, 118 proximal the sides of the outer cylinder 46 of the control assembly 40 and pivotally mount to a first end of the grooved shafts 142, 144. Preferably, the longitudinal axes of the grooved shafts 142, 144 and the outer cylinder 46 are parallel to each another and positioned within the same plane. Further, the grooved shafts 142, 144 extend to a second end within the manifold 190 proximal a back end 172. A shaft sleeve, mounted within a first end 170 of the manifold 190 and partially extending towards the back end 172 of the manifold 190, surrounds the grooved shafts 142, 144 and allows the shafts to translate.

Figure 5:
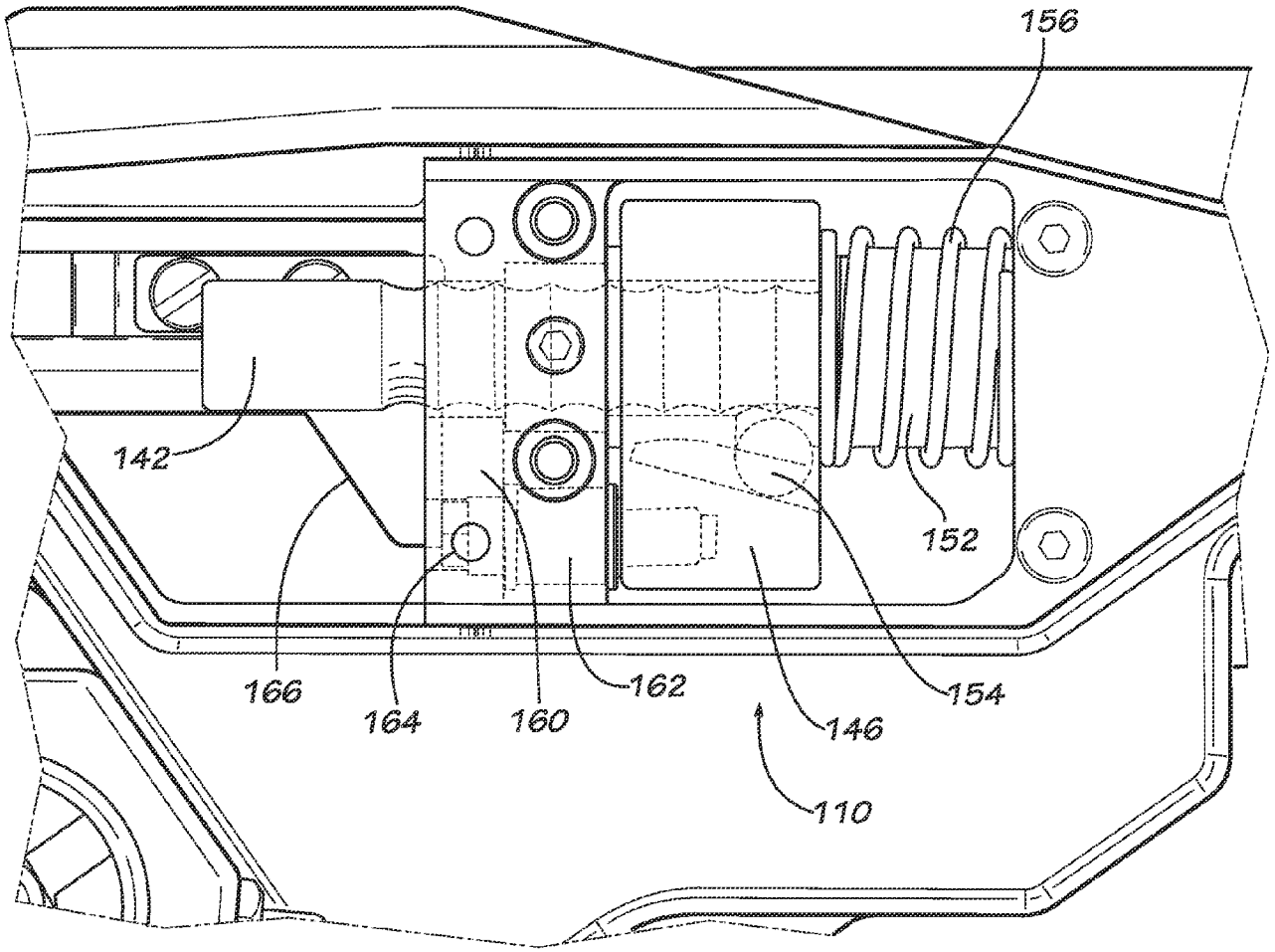
FIG. 5 is a schematic side view of an angle locking system of the control assembly of FIG. 3.

In a locked configuration (the box 26 free, not pressed against a flat surface and the biasing spring 66 forcing the inner cylinder proximal the front side 42 of the control assembly 40), a tab 168 of the L-shaped arm 166 abuts the fastener 164, mounted via a mounting cylinder 162 to the secondary collar 160 and the lock collar 146, thereby compressing the biasing spring 156 and forcing the lock collar 146 proximal the front end 170 of the manifold 190 (see FIG. 5). Preferably, the L-shaped arm 166 is mounted to the inner cylinder by one or more bolts or connectors 169 and is limited to translation within a defined slot of the outer cylinder, thereby prohibiting the inner cylinder 60 from removing itself from the outer cylinder 46. Moreover, the slot of the outer cylinder is generally sized upon the allowable extension and retraction of the inner cylinder 60. With the tab 168 forcing the lock collar 146 proximal the front end 170 of the manifold 190, a cam ramp 148 of the lock collar 146 forces the lock ball 154 within an orifice of the shaft sleeve, thereby nesting the lock ball 154 within a groove of the grooved shafts 142, 144 and preventing the shafts from translating into and out of the manifold 190.

Figure 12:
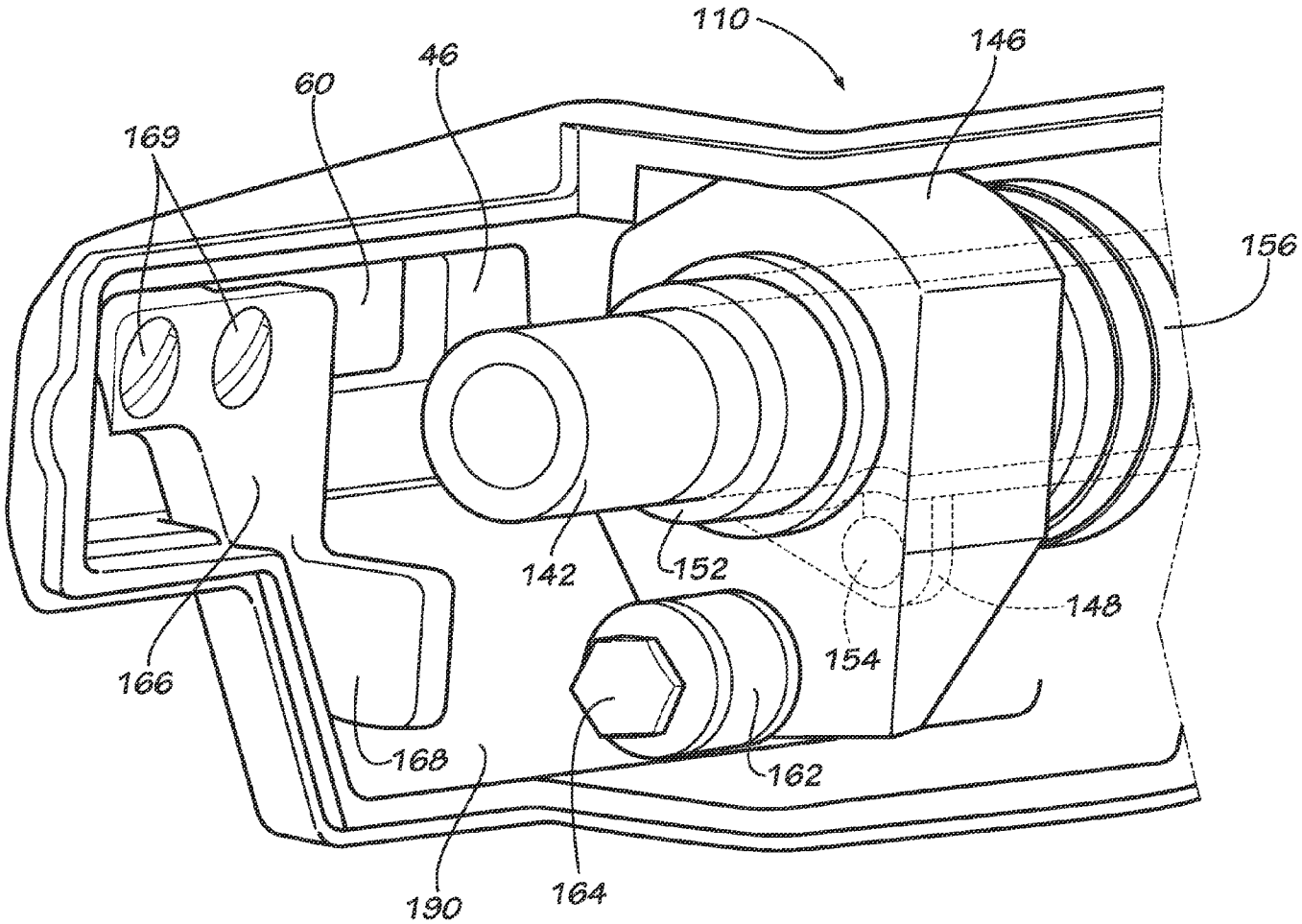
FIG. 12 is a perspective internal view of the angle locking system of FIG. 5.

In an unlocked configuration (with the box 26 pressed against a flat surface and the biasing spring 66 forcing the inner cylinder proximal the rear side 44 of the control assembly 40), the L-shaped arm 166 is retracted proximal the rear end 172 of the manifold 190 (see FIGS. 3, 5, and 12). The biasing spring 156 biases the lock collar 146 away from the front end 170 of the manifold 190, thereby allowing the lock ball 154 to rest within the cam ramp 148 without nesting within the orifice of the shaft sleeve 152. Moreover, the grooved shafts 142, 144 pivotally mounted to the L-shaped strut 112 can translate into and out of the manifold, thereby providing adjustment to the angle of the head assembly 20 relative to the control assembly 40. Preferably, the lock ball 154 is constrained to vertical motion within the cam ramp, wherein a portion of the lock ball 154 will remain within the orifice of the shaft sleeve 152 and the rearward and forward motion of the lock collar 146 and integral cam ramp 148 constrain and free the lock ball 154 to and from the orifice of the shaft sleeve 152.

Figure 6:
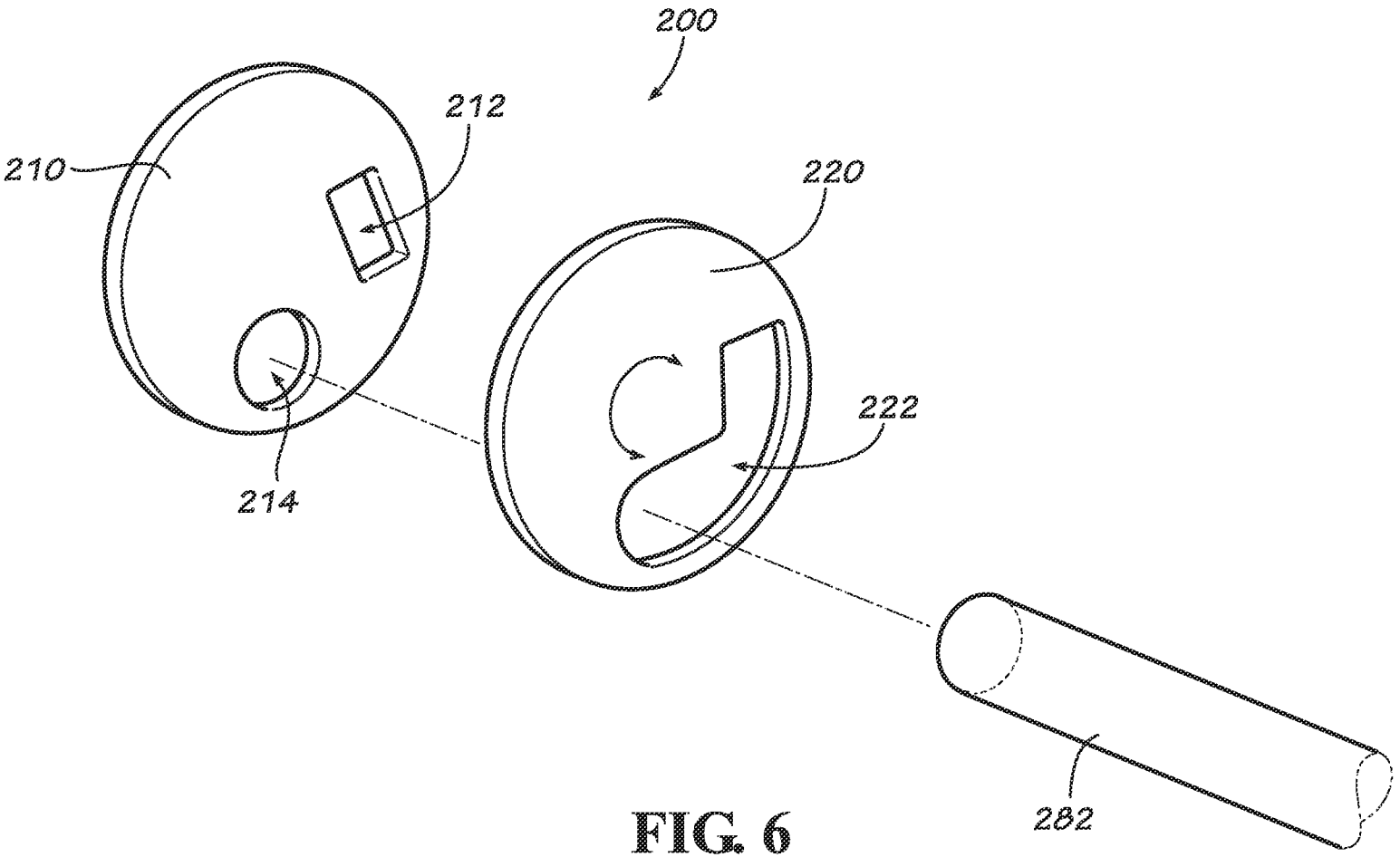
FIG. 6 is an exploded perspective view of a variable orifice valve assembly of the wall finishing apparatus of FIG. 1.
Figure 7:
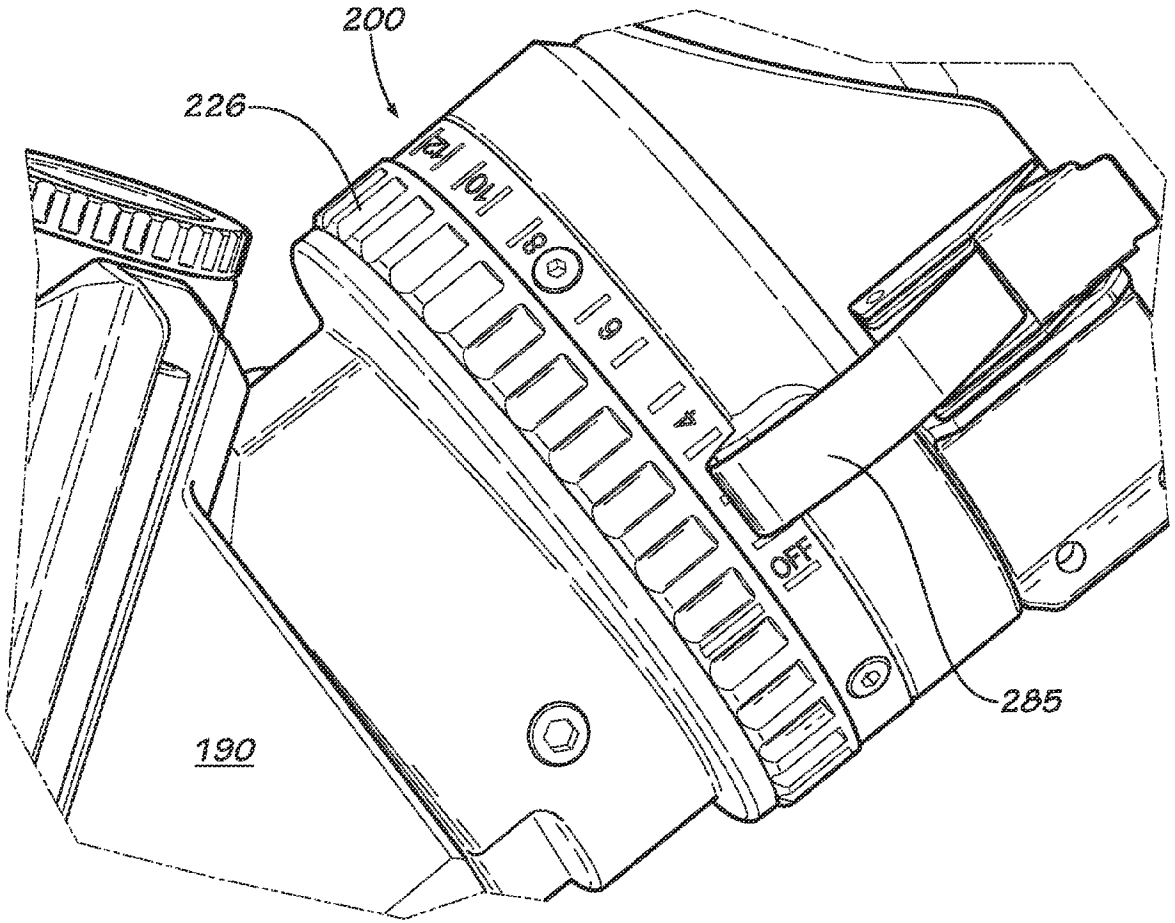
FIG. 7 is an assembled perspective view of the variable orifice valve assembly of FIG. 6.

FIGS. 6 and 7 show an optional flow rate control valve comprising a variable orifice valve assembly 200 to meter and adjust the flow rate of mixture therethrough. In general, the variable orifice valve assembly 200 is mounted to the manifold 190 that encases and mounts to the outer cylinder 46. A fixed flow control plate 210 defines a fill orifice 212 and a flow control metering orifice 214 and is fixed within the valve assembly 200. Preferably, the fixed flow control plate 210 is positioned such that the fill orifice 212 is adjacent to the filler port 198 of the control assembly 40 for providing an opening for filling the mud supply tube 282 with a cementitious mixture therethrough. A pivoting flow control plate 220, overlying the fixed flow control plate 210 and defining a boomerang-shaped orifice 222, is pivotally mounted within the valve assembly 200, and includes a mudflow control dial 226 for manually pivoting the flow control plate 220. The dial 226 is adjustable from an "off" orientation, wherein the flow control metering orifice 214 is completely closed allowing no mixture to flow therethrough, to an "on" orientation. Moreover, the opening of the flow control metering orifice 214 can be varied on a scale from 1-12 (see FIG. 7). The boomerang shaped orifice 222 can be varied in exposed aperture as the pivoting flow control plate 220 is pivoted, while the fill orifice remains unvaried in aperture regardless of the position of the pivoting flow control plate 220.

In commercial applications of the example embodiments, the wall finishing apparatus 10 can be constructed of steel, aluminum (i.e.; cast aluminum), composites, rubbers, plastics, other known materials or combination herein. In operation, a user or operator fills the wall finishing apparatus 10 with a cementitious mixture via the filling station 350 and can apply the mixture to a flat surface. Preferably, the user grasps the mud supply tube with one hand and grasps the cylindrical cover of the gas pressure cylinder with the other hand. With the user holding and supporting the apparatus 10, the user presses the head assembly against the flat surface. When the head assembly is pressed against the flat surface, the head assembly may pivot relative to the control assembly for accommodating the user's hand positions relative to a plurality of flat surfaces, for example a wall and/or a ceiling. Additionally, when the head assembly is pressed against the flat surface, the orifices 49, 63 of the mixture control valve align and the gas pressure cylinder and mounted plunger force the cementitious mixture to flow from the mud supply tube to the head of the flat finishing box 26, passing through the variable orifice valve, outer and inner cylinders, ball-extension cylinder and head assembly. The flow can be adjusted by varying the mudflow control dial mounted to the pivoting flow control plate comprising the boomerang-shaped orifice. To stop the flow of the cementitious mixture, the head assembly is removed from the flat surface. Moreover, when removing the head assembly from the flat surface, the angular position of the head assembly relative to the control assembly before and after the removal will remain the same.

As depicted in FIG. 11, optionally the filler neck 358 of the manual pump further comprises a bayonet mount 362 for mounting to the filler port 198 of the control assembly 40. The bayonet mount generally comprises a collar 364 translatably mounted to an open end of the filler neck 358. The collar 364 is axially aligned with the filler neck 358 and can translate along the longitudinal axis of the open end of the filler neck, wherein a pin of the filler neck engages a slot within the collar 366 to permit translation defined by the length of the slot. An end of the collar proximal the open end of the filler neck 358 comprises a flange 368 and an engagement slot 370 for locking to the filler port 198. With the filler port 198 axially aligned with and proximal the bayonet mount 362, a mounting pin 199 proximal the filler port 198 engages the engagement slot 368 of a flange 366 that is integral with the bayonet mount 362. The filler port is rotated (further rotating the wall finishing apparatus 10) and the bayonet mount 362 locks the filler port 198 to the filler neck 358. Further, an o-ring 360 within the open end of the filler neck 358 seals the connection and prevents the cementitious mixture from leaking when filling the wall finishing apparatus 10. In additional example embodiments, the bayonet mount 362 is translated back from the open end of the filler neck 358 for providing prior art tools (not equipped for a bayonet mount) to utilize the filling station of the present invention.

Figure 13:
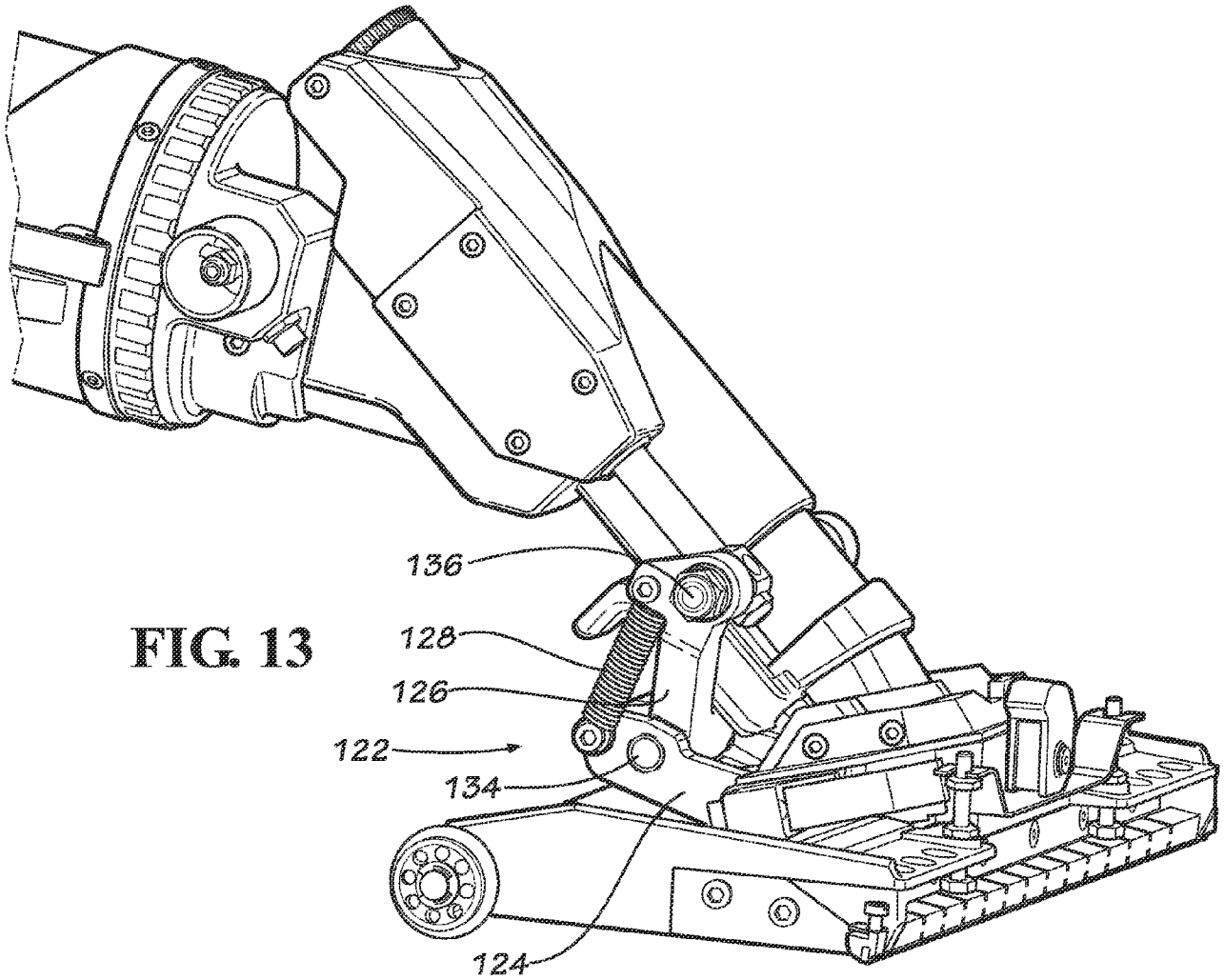
FIG. 13 is a perspective view of the control assembly and the head assembly according to an additional example embodiment of the present invention, showing a pivotal L-shaped yoke connected therebetween.

In additional example embodiments, the L-shaped strut or yoke 112 previously described can comprise a pivotal L-shaped strut or yoke 122. The pivotal L-shaped strut 122 provides the user with additional flexibility when adjusting the angle of the head assembly 20 relative to the control assembly 40. As depicted in FIG. 13, the pivotal L-shaped strut comprises a first leg 124 pivotally mounted to each side of the ball-mount collar 90 at a first end (unshown) and pivotally mounted to a pivot axle 134 at a second end. Further, a second leg 126 pivotally mounts to the grooved shafts 142, 144 at a first (upper) end 136 and pivotally mounts to the pivot axle 134 at a second (lower) end. Additionally, biasing springs 128, 129 mount to the first (upper) ends of the second arm 126 and mount to the second end of the first leg 124. Preferably, when pressing the head assembly 20 against a flat surface and prior to unlocking the angle locking system 110, a pivotal action of the L-shaped strut 122 allows for slight adjustment to the angle of the head assembly 20 relative to the control assembly 40. The pivotal action forces the biasing springs 128, 129 to expand or stretch, thereby altering the position of the L-shaped strut 122. Further, when the angle locking system 110 is unlocked, the biasing springs 128, 129 bias the pivotal L-shaped strut 122 back to its original L-shape position. Optionally, the biasing springs 128, 129 can be interchanged to vary the tension of the pivotal action as desired.

While the invention has been shown and described in exemplary forms, it will be apparent to those skilled in the art that many modifications, additions, and deletions can be made therein without departing from the spirit and scope of the invention as defined by the following claims.

What is claimed is:

1. A tool for applying a cementitious mixture to a flat surface comprising:

a head assembly for delivering the mixture to the flat surface;

a housing for containing a supply of the mixture; and a control assembly between the housing and the head assembly for controlling the flow of the mixture from the housing to and through the head assembly, the control assembly being responsive to the housing being pressed against the flat surface to control the angle of the head assembly relative to the control assembly and to control the flow of the mixture through the head assembly, wherein the control assembly includes a first external part and a second internal part movably mounted within the first external part and wherein when the head assembly is pressed against the flat surface the second internal part is forced farther into the first external part and by such motion the head assembly is unlocked for pivotal motion relative to the control assembly and the flow of the mixture through the head assembly is permitted.

2. A tool as claimed in claim 1 wherein when the head assembly is pressed against the flat surface the head assembly can be pivoted relative to the control assembly and wherein when the head assembly is withdrawn from the flat surface the control assembly locks the head assembly in a fixed angular position relative to the control assembly.

3. A tool as claimed in claim 1 wherein the control assembly includes a flow control valve and wherein when the head assembly is pressed against the flat surface the flow control valve in the control assembly is opened to allow the mixture to flow there through and wherein when the head assembly is withdrawn from the flat surface the flow control valve in the control assembly closes to stop the flow of the mixture there through.

4. A tool as claimed in claim 1 wherein when the head assembly is pulled away from the flat surface the second internal part is partially withdrawn from the first external part and by such motion the head assembly is locked to prevent pivotal motion relative to the control assembly and the flow of the mixture through the head assembly is blocked.

5. A tool as claimed in claim 1 further comprising a gas pressure cylinder for forcing the mixture from the housing through the control assembly and through the head assembly.

6. A tool as claimed in claim 5 further comprising a visual scale for indicating the amount of mixture remaining in the housing.

7. A tool as claimed in claim 1 further comprising a filler port for pumping the mixture from an external reservoir into the housing.

8. A tool as claimed in claim 3 wherein the flow control valve comprises a fixed flow control plate and a pivoting flow control plate overlying the fixed flow control plate, with the fixed flow control plate including a fill orifice and a mixture control orifice and the second pivoting flow control plate includes a boomerang shaped orifice adapted and configured such that the mixture control orifice can be varied in aperture as the pivoting flow control plate is pivoted, while the fill orifice remains unvaried in aperture regardless of the position of the pivoting flow control plate.

9. A tool for applying a cementitious mixture to a flat surface comprising: a head assembly for delivering the mixture to the flat surface; a housing for containing a supply of the mixture; and a control assembly between the housing and the head assembly for controlling the flow of the mixture from the housing to and through the head assembly, the control assembly being responsive to the housing being pressed against the flat surface to control the flow of the mixture through the head assembly:

wherein the control assembly includes an outer cylinder and an inner cylinder movably mounted within the outer cylinder and wherein when the head assembly is pressed against the flat surface the inner cylinder is forced farther into the outer cylinder and by such motion the head assembly is unlocked for pivotal motion relative to the control assembly and the flow of the mixture through the head assembly is permitted.

10. A tool as claimed in claim 9 wherein when the head assembly is pressed against the flat surface the head assembly can be pivoted relative to the control assembly and wherein when the head assembly is withdrawn from the flat surface the control assembly locks the head assembly in a fixed angular position relative to the control assembly.

11. A tool as claimed in claim 9 wherein the control assembly includes a flow control valve and wherein when the head assembly is pressed against the flat surface the flow control valve in the control assembly is opened to allow the mixture to flow there through and wherein when the head assembly is withdrawn from the flat surface the flow control valve in the control assembly closes to stop the flow of the mixture there through.

12. A tool as claimed in claim 9 wherein when the head assembly is pulled away from the flat surface the second internal part is partially withdrawn from the first external part and by such motion the head assembly is locked to prevent pivotal motion relative to the control assembly and the flow of the mixture through the head assembly is blocked.

13. A tool for applying a cementitious mixture to a flat surface comprising: a head assembly for delivering the mixture to the flat surface; a housing for containing a supply of the mixture; and a control assembly between the housing and the head assembly for controlling the flow of the mixture from the housing to and through the head assembly, the control assembly being responsive to the housing being pressed against the flat surface to control the angle of the head assembly relative to the control assembly;

wherein the control assembly includes an outer cylinder and an inner cylinder movably mounted within the outer cylinder and wherein when the head assembly is pressed against the flat surface the inner cylinder is forced farther into the outer cylinder and by such motion the head assembly is unlocked for pivotal motion relative to the control assembly.

14. A tool as claimed in claim 13 wherein the control assembly also is responsive to the head assembly being pressed against the flat surface to control the flow of the mixture through the head assembly.

15. A tool as claimed in claim 13 wherein when the head assembly is pressed against the flat surface the head assembly can be pivoted relative to the control assembly and wherein when the head assembly is withdrawn from the flat surface the control assembly locks the head assembly in a fixed angular position relative to the control assembly.

16. A tool as claimed in claim 13 wherein the control assembly includes a flow control valve and wherein when the head assembly is pressed against the flat surface the flow control valve in the control assembly is opened to allow the mixture to flow there through and wherein when the head assembly is withdrawn from the flat surface the flow control valve in the control assembly closes to stop the flow of the mixture there through.

17. A tool as claimed in claim 13 wherein the control assembly includes an outer cylinder and an inner cylinder movably mounted within the outer cylinder and wherein when the head assembly is pressed against the flat surface the inner cylinder is forced farther into the outer cylinder and by such motion the head assembly is unlocked for pivotal motion relative to the control assembly and the flow of the mixture through the head assembly is permitted.

18. A tool as claimed in claim 4 wherein the first external part is an outer cylinder and the second internal part is an inner cylinder.

* * * * *